US007040246B1

(12) United States Patent
Doleski et al.

(10) Patent No.: US 7,040,246 B1
(45) Date of Patent: May 9, 2006

(54) SUBMARINE COUNTERMEASURE AND LAUNCH ASSEMBLY

(75) Inventors: Robert F. Doleski, Middletown, RI (US); Stephen F. Oliver, Portsmouth, RI (US); Stanley J. Olson, Newport, RI (US)

(73) Assignee: The United States of America represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/099,779

(22) Filed: Apr. 4, 2005

(51) Int. Cl.
*B63B 1/00* (2006.01)
*B63B 5/00* (2006.01)

(52) U.S. Cl. ..... 114/238; 89/1.8

(58) Field of Classification Search ..... 114/238, 114/239, 20.1, 20.2, 22; 89/1.8–1.89
See application file for complete search history.

(56) References Cited

U.S. PATENT DOCUMENTS 3,754,725 A 8/1973 Kartzmark et al.
5,333,570 A 8/1994 DuBois et al.
5,396,855 A 3/1995 Dubois et al.
5,495,819 A * 3/1996 Marion ..... 114/238
5,737,962 A 4/1998 Turner et al.
5,771,741 A 6/1998 Roy et al.
6,559,370 B1 * 5/2003 Barker ..... 114/20.2
6,568,309 B1 * 5/2003 MacLeod ..... 89/1.81

* cited by examiner

*Primary Examiner*—Michael Carone
*Assistant Examiner*—Gabriel J. Klein
(74) *Attorney, Agent, or Firm*—James M. Kasischke; Jean-Paul A. Nasser; Michael P. Stanley

(57) ABSTRACT

In a submarine countermeasure vehicle and launch assembly the vehicle includes a forward end portion, an aft end portion provided with a propeller and fins, a hull portion extending between the forward and aft portions, the hull portion being circular in cross-section, and a thrust ring mounted on the fins and around the propeller, the thrust ring forming a convex configuration. The launch assembly includes a launch tube for retaining and launching the vehicle, a ram plate moveable in the launch tube to push the vehicle out an end of the launch tube, the ram plate having an engagement surface for contact with the thrust ring, the engagement surface being at least in part of a concave configuration. In a launch operation, the concave surface of the ram plate engages the convex configuration of the thrust ring.

10 Claims, 6 Drawing Sheets

SUBMARINE COUNTERMEASURE AND LAUNCH ASSEMBLY

STATEMENT OF GOVERNMENT INTEREST

The invention described herein may be manufactured and used by and for the Government of the United States of America for Governmental purposes without the payment of any royalties thereon or therefor.

BACKGROUND OF THE INVENTION

1. Field of the Invention

This invention relates to submarine countermeasure vehicles and launchers and is directed more particularly to a countermeasure and launch assembly which alleviates problems developed in launching by translation or tilting of the countermeasure vehicle in the launch tube.

2. Description of the Prior Art

In FIG. 1, there is shown a typical submarine countermeasure apparatus 20. The apparatus 20 includes a launch tube 22 which, in operation, is disposed outboard of the submarine pressure hull (not shown). A countermeasure vehicle 24 is housed in the launch tube 22 and includes an array assembly 26 and a tailcone assembly 28. The array assembly 26 is protected by a surrounding sabot 30. Disposed in the launch tube 22 is a ram plate 32 and a gas generator 34. The launch tube is closed by a forward tube cover 36 and an aft tube cover 38.

In operation, the gas generator 34 is activated by an electrical pulse from the submarine fire control system and generates sufficient gas pressure to move the ram plate 32 forwardly. The ram plate 32 pushes the countermeasure vehicle 24 forwardly, breaking away the forward tube cover 36 and launching the countermeasure vehicle 24 from the launch tube 22. In due course, the sabot 30 disengages from around the array assembly 26 and the array assembly is deployed.

It has been found that upon launch of the countermeasure vehicle 24, the fleet vehicle design is sometimes subjected to substantial bending moments when most of the cylindrical vehicle, but not the cylindrical tailcone assembly 28, has exited the launch tube. This occurs from cross flow on the vehicle hull from launching perpendicular to the submarine hull flow. This results in the vehicle 24 being moved sideways in the tube 22, and/or being tilted in the tube as the launch progresses. This may result in potentially asymmetrical axial loading of the ram plate 32 which could jam the ram plate 32 intermittently during launch. Any of these conditions can compromise the launch and the resulting deployment. It may also catastrophically result in complete failure of the tailcone assembly 28 forward hull joint and/or the local aft zone of the vehicle 24 hull structure thereby destroying or critically damaging the vehicle.

Accordingly, there is a need for an improved vehicle and launch assembly which can accommodate severe bending moments and complete a launch under such conditions satisfactorily.

SUMMARY OF THE INVENTION

An object of the invention is, therefore, to provide an improved vehicle and launch assembly facilitating launches of the vehicle in severe environments which cause translation and/or tilting of the vehicle in the launch tube.

With the above and other objects in view, as will hereinafter appear, a feature of the present invention is the provision of a submarine countermeasure vehicle and launch assembly therefor. The vehicle comprises a forward end portion, an aft end portion provided with a propeller and fins extending therefrom, a hull portion extending between the forward end portion and the aft end portion, the hull portion being substantially circular in cross-section, and a thrust ring mounted on aft portions of the fins and around the propeller, the thrust ring forming a convex configuration. The launch assembly comprises a launch tube for retaining and launching the vehicle, and a ram plate moveable in the launch tube to push the vehicle out an end of the launch tube, the ram plate having an engagement surface for contact with the thrust ring, the engagement surface being at least in part of a concave configuration. In a launch operation, the concave surface of the ram plate engages the convex configuration of the thrust ring.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENTS

Figure 1:
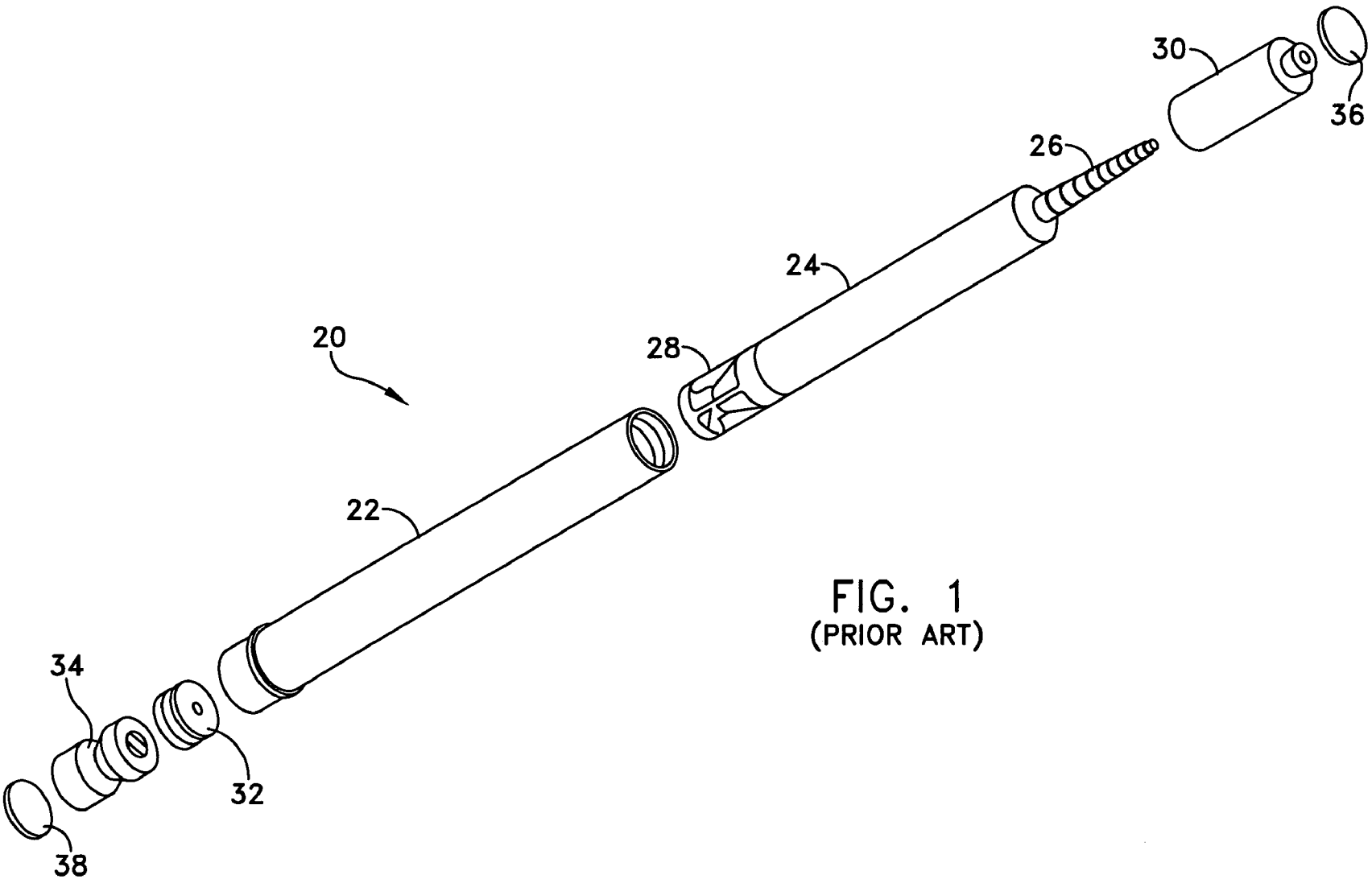
FIG. 1 (PRIOR ART)
FIG. 1 is an exploded perspective view of a prior art form of submarine countermeasure vehicle and launch assembly.
Figure 2:
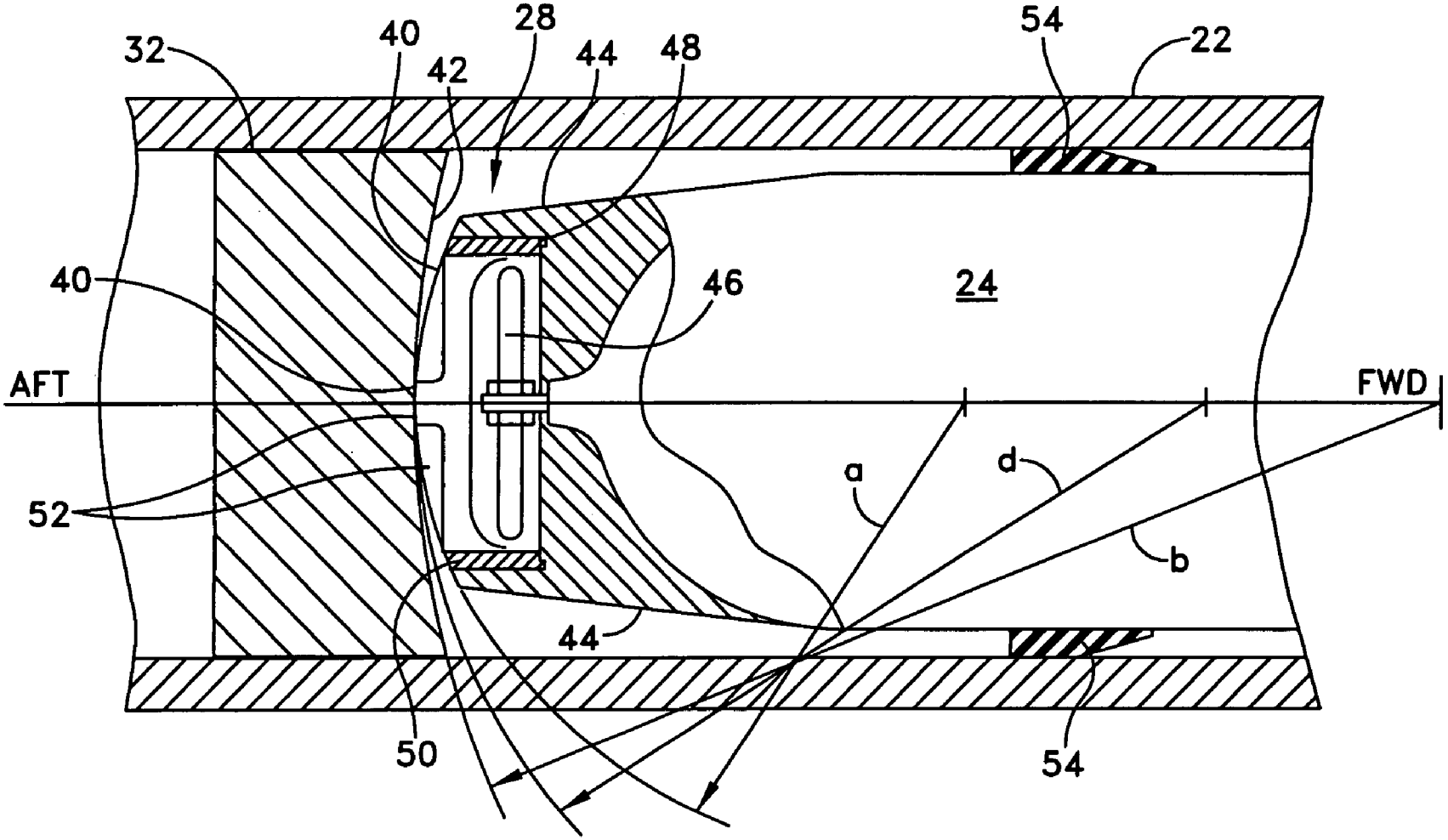
FIG. 2 is a partially broken-away, partially sectional view of portions of a vehicle and launch assembly showing one form of assembly illustrative of an embodiment of the invention.
Figure 3:
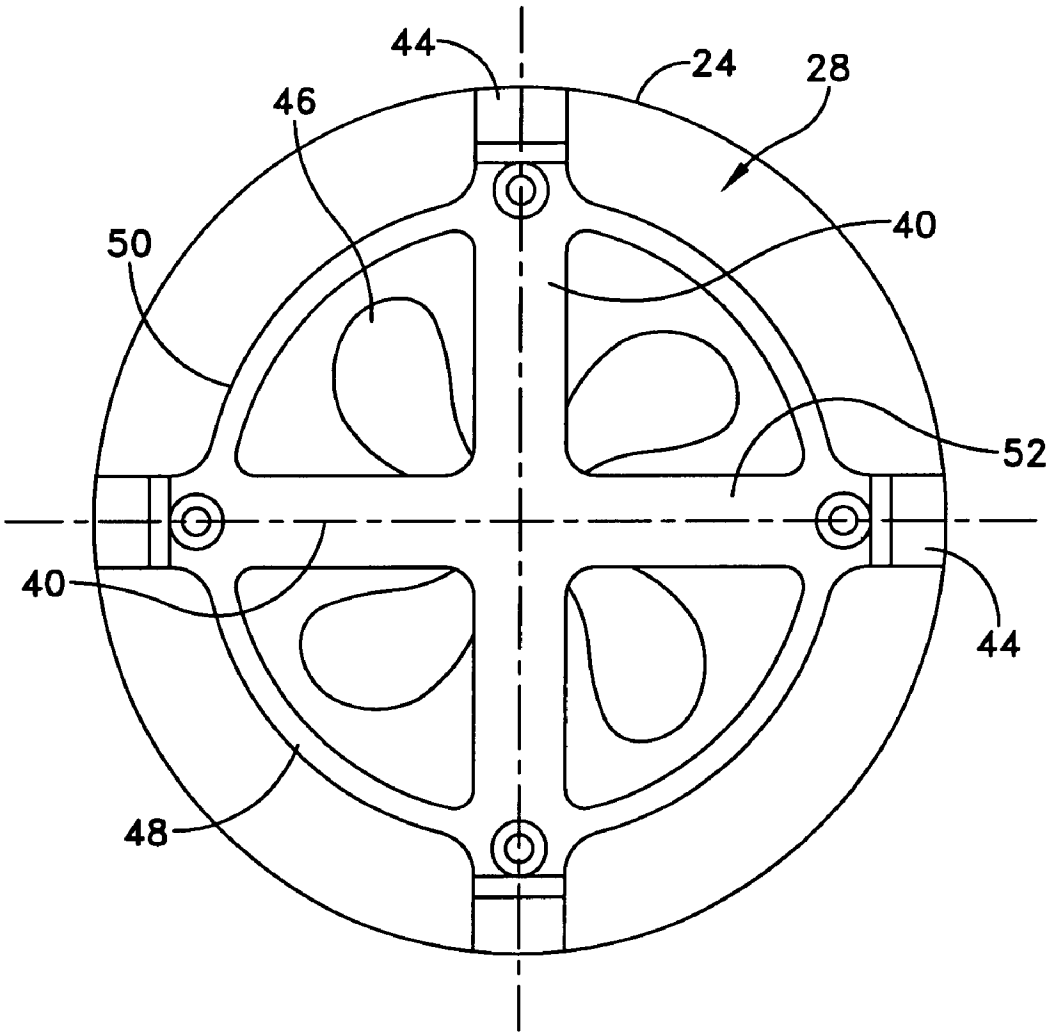
FIG. 3 is an end view of the assembly of FIG. 2.

Referring to FIG. 2, it will be seen that in an improved countermeasure vehicle and launch assembly, the vehicle 24 is provided with a tailcone assembly 28 having an aft end 40 of a convex configuration.

The launch assembly includes the launch tube 22 and ram plate 32, the latter provided with a concave surface 42 for engagement with the tail cone assembly aft end convex structure 40.

The tailcone assembly 28 includes fins 44 disposed around a propeller 46 and to which is fixed a thrust ring 48. The thrust ring 48 includes a collar portion 50 and hydrodynamically configured radial struts 52 which define the aforesaid tailcone assembly aft end convex configuration. Tailcone assembly 28 and fins 44 can be tapered to avoid contact between tailcone 28 and tube 22 during launch. This will minimize moment loading in the aft structure and joints of the vehicle 24.

When the vehicle 24 rests in the launch tube 22, the surfaces 40 and 42 are in engagement with each other. As noted above, upon initiation of a launch, the ram plate 32 pushes the vehicle 24 at a high rate of speed and ejects the vehicle 24 from the launch tube 22.

Figure 4:
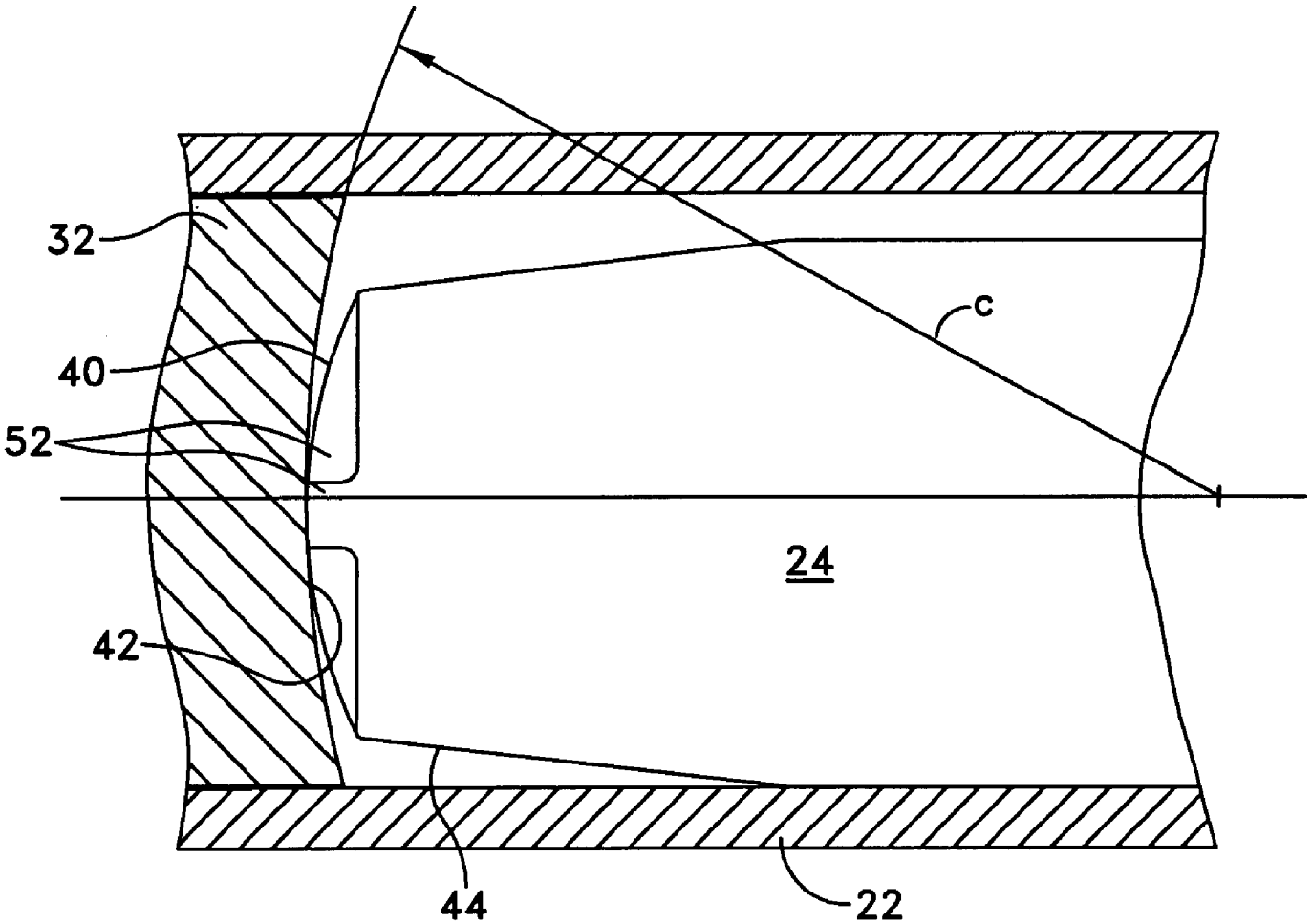
FIG. 4 is a partly side elevational and partly sectional view of the assembly showing an alternative embodiment in positions resulting from translation of the vehicle in the launch tube.

To assist in maintaining the vehicle 24 contained within the launch tube 22, the vehicle 24 is conventionally provided with elastomeric pads 54 temporarily bonded to vehicle 24 (FIG. 2). However, despite such pads 54 the vehicle 24 on occasion translates to a position off-center in the launch tube (FIG. 4) or becomes tilted in the tube (FIG. 5).

It has been found that providing the concave engagement surface 42 on the ram plate 32 and the convex configuration 40 on the tail cone thrust ring 48, results in the center of thrust being displaced from center only slightly, such that the vehicle 24 is thrust in a direction axial of the launch tube, and jamming of the vehicle 24 in the tube 22 is substantially less likely to occur under even the worst of ambient conditions.

It has further been found that an appropriate radius of curvature a for the convex configurations of the thrust ring 48 is about 6.25 inches, and that a preferred radius of curvature b for the ram plate engagement surface 42 is twice the radius of curvature a, or about 12.5 inches. Alternative radii of curvature for the ram plate engagement surface 42 are 9.75 inches, shown at c in FIG. 6, and 9.375 inches, shown at d in FIG. 4. All of the above mentioned radii have been found to permit the vehicle to realign itself relative to the ram plate.

Figure 5:
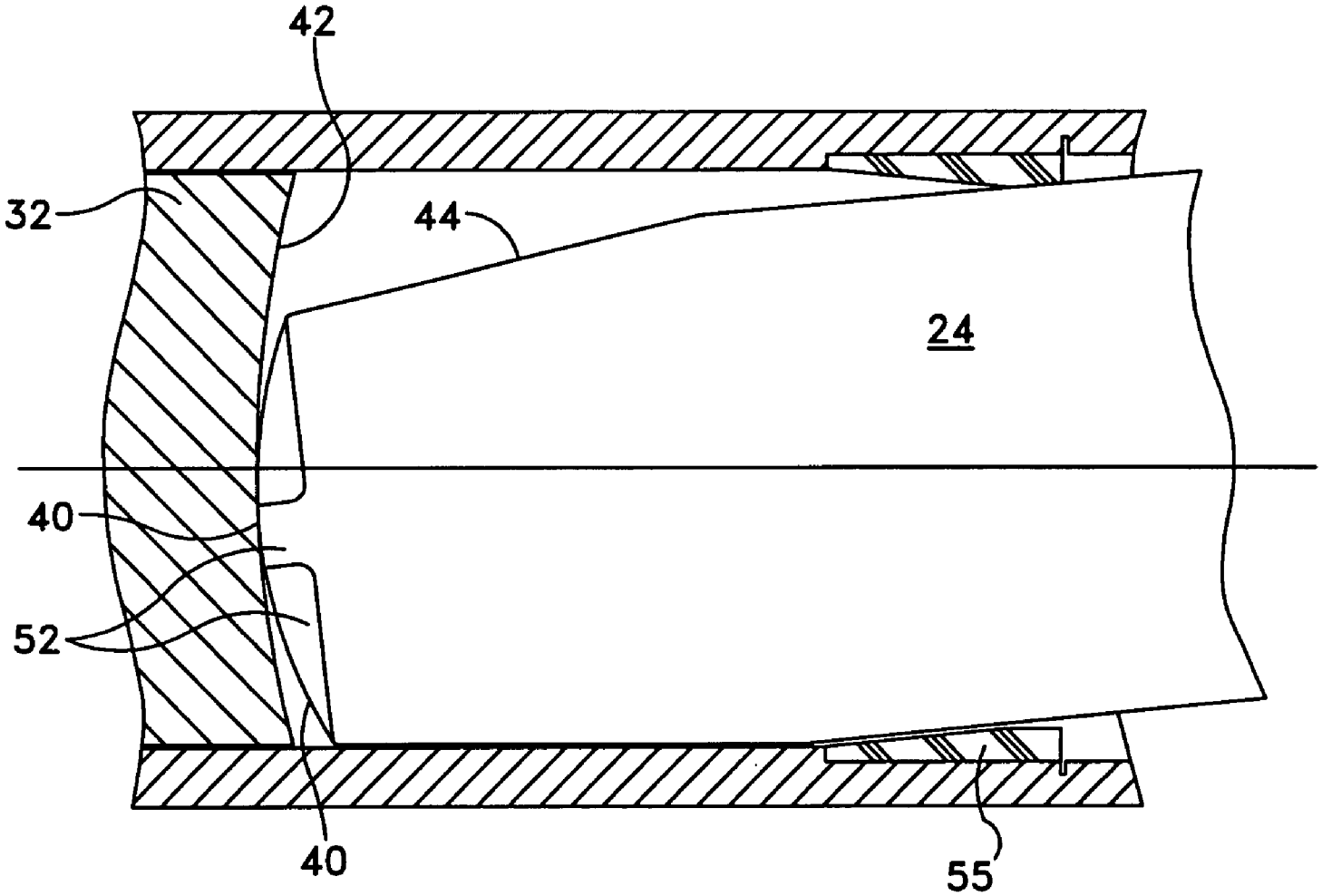
FIG. 5 is similar to FIG. 4, but illustrative of the assembly portions of FIG. 4 in positions resulting from tilting of the vehicle in the launch tube while passing through the ram-plate retainer ring.

FIG. 5 shows how the thrust vector remains essentially on center even with the vehicle pitched to a maximum of seven degrees. Also shown in FIG. 5 is a ramplate retainer ring 55. The ramplate retainer ring 55 detaches the pads 54 when the pads 54 pass the ring 55.

Figure 6:
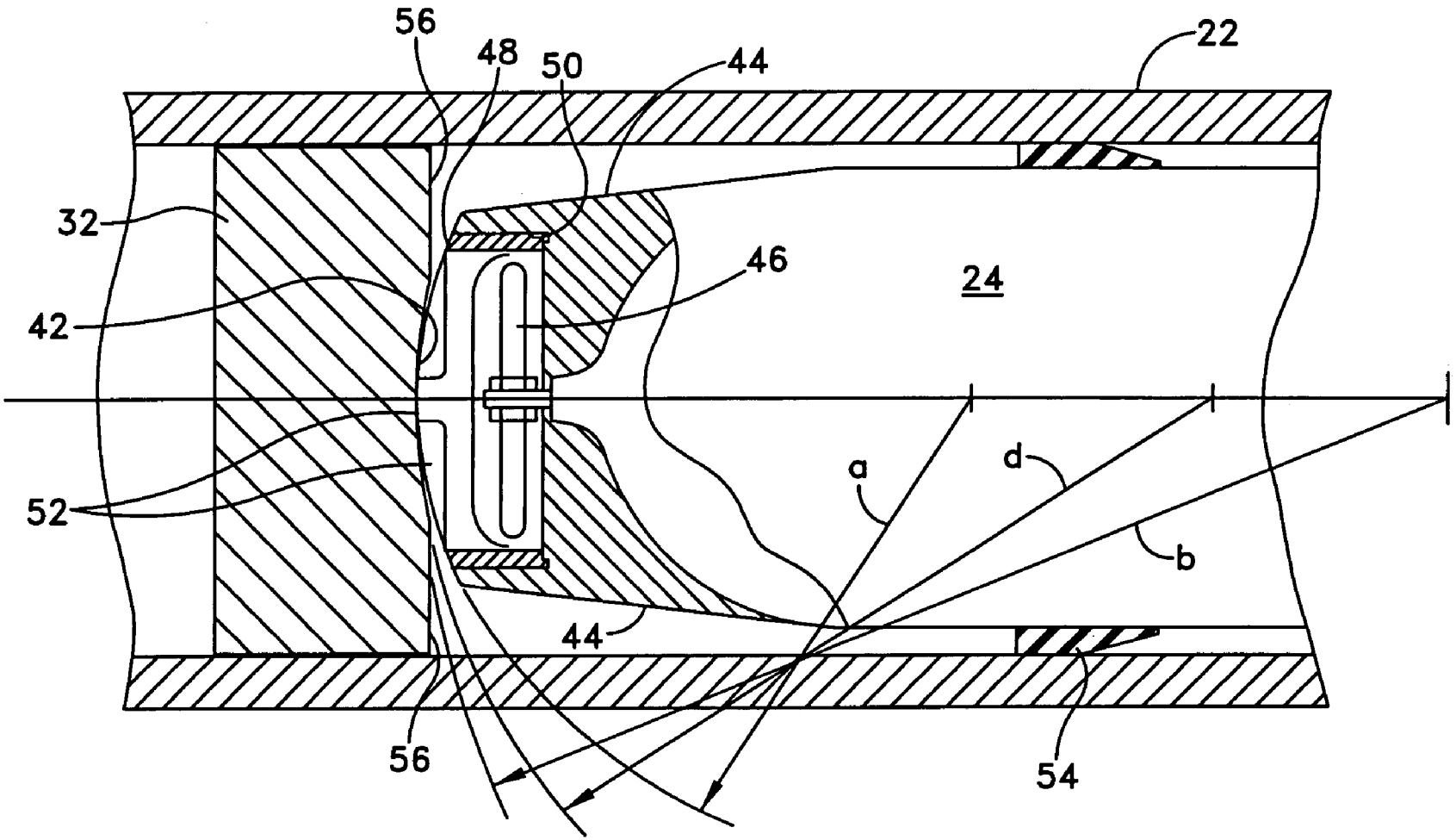
FIG. 6 is similar to FIG. 2, but illustrative of further alternative embodiments.

Referring to FIG. 6, it will be seen that the concave surface 42 of the ram plate 32 may be bounded by an annular peripheral planar portion 56, rather than extending throughout the diameter of the ram plate. In this embodiment, less machining of the ram plate is required and does not appear to affect the operation of the ram plate or results obtained thereby.

Thus, the ram plate concave surface 42 and the tail cone aft end convex configuration 40 allow the tailcone 28 to slide on the ram plate surface 42 and maintain the thrust vector substantially in the center of the ram plate, which in turn minimizes the possibility of jamming and high bending moments during a launch in a severe environment.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A submarine countermeasure vehicle and launch assembly therefor, the vehicle comprising:

a forward end portion;

an aft end portion provided with a propeller and fins extending therefrom;

a hull portion extending between said forward end portion and said aft end portion, said hull portion being substantially circular in cross-section; and a thrust ring mounted on portions of the fins and around the propeller, said thrust ring forming a convex configuration; and the launch assembly comprising:

a launch tube for retaining and launching the vehicle;

a ram plate moveable in said launch tube to push the vehicle out an end of the launch tube, said ram plate having an engagement surface for contact with said thrust ring, the engagement surface being at least in part of a concave configuration;

wherein in a launch operation the concave surface of said ram plate engages the convex configuration of the thrust ring.

2. The vehicle and launch assembly in accordance with claim 1 wherein the aft end portion of the vehicle is tapered.

3. The vehicle and launch assembly in accordance with claim 2 wherein the ram plate concave surface is defined by a radius larger than a radius defining the thrust ring convex configuration.

4. The vehicle and launch assembly in accordance with claim 3 wherein the ram plate concave surface is defined by a radius of about twice the length of the radius defining the thrust ring convex surface.

5. The vehicle and launch assembly in accordance with claim 4 wherein the radius of the ram plate surface is about 12.50 inches and the radius of the thrust ring surface is about 6.25 inches.

6. The vehicle and launch assembly in accordance with claim 3 wherein the ram plate concave surface is defined by a radius of a selected one of 12.5 inches, 9.75 inches and 9.375 inches, and the thrust ring convex surface is defined by a radius of about 6.25 inches.

7. The vehicle in accordance with claim 3 wherein the ram plate concave surface extends substantially across the whole of the engagement surface of said ram plate.

8. The vehicle in accordance with claim 3 wherein the ram plate engagement surface is provided with a peripheral planar portion and the concave surface is disposed centrally of the planar portion.

9. The vehicle in accordance with claim 1 wherein the ram plate concave surface extends substantially across the whole of the engagement surface of said ram plate.

10. The vehicle in accordance with claim 1 wherein the ram plate engagement surface is provided with a peripheral planar portion and the concave surface is disposed centrally of the planar portion.

* * * * *